US011193194B2

(12) United States Patent
Lee et al.

(10) Patent No.: US 11,193,194 B2
(45) Date of Patent: Dec. 7, 2021

(54) FRICTION PART HAVING WEAR RESISTANT COATING AND COATING METHOD THEREFOR

(71) Applicants: Hyundai Motor Company, Seoul (KR); Kia Motors Corporation, Seoul (KR)

(72) Inventors: Ill Joo Lee, Seoul (KR); Chul Ho Kim, Incheon (KR); Min Gyun Chung, Gyeonggi-do (KR); Yong Sang Joo, Gyeonggi-do (KR); Jae Young Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 667 days.

(21) Appl. No.: 15/978,649

(22) Filed: May 14, 2018

(65) Prior Publication Data

US 2019/0177827 A1 Jun. 13, 2019

(30) Foreign Application Priority Data

Dec. 13, 2017 (KR) ..... KR10-2017-0171571

(51) Int. Cl.

| | |
|---|---|
| ***C22C 38/00*** | (2006.01) |
| ***C22C 38/02*** | (2006.01) |
| ***C22C 38/40*** | (2006.01) |
| ***C23C 4/11*** | (2016.01) |
| ***C23C 4/129*** | (2016.01) |

(Continued)

(52) U.S. Cl.

CPC ..... *C23C 4/11* (2016.01); *C22C 38/002* (2013.01); *C22C 38/02* (2013.01); *C22C 38/04* (2013.01); *C22C 38/08* (2013.01); *C22C 38/18* (2013.01); *C22C 38/40* (2013.01); *C22C 38/60* (2013.01); *C23C 4/129* (2016.01)

(58) Field of Classification Search

CPC ..... C23C 4/11; C22C 38/60; C22C 38/18; C22C 38/08; C22C 38/129; C22C 38/002; C22C 38/02; C22C 38/04; C22C 38/40

See application file for complete search history.

(56) References Cited

U.S. PATENT DOCUMENTS

| | | | | |
|---|---|---|---|---|
| 3,690,686 A * | 9/1972 | Prasse | F16J 9/26 | 277/444 |
| 5,614,022 A * | 3/1997 | Vatavuk | C23C 4/02 | 118/302 |
| 2013/0216862 A1* | 8/2013 | Cheney | C22C 19/056 | 428/656 |

FOREIGN PATENT DOCUMENTS

| | | | |
|---|---|---|---|
| CN | 102660706 A * | 9/2012 | |
| KR | 20160027344 A | 3/2016 | |

OTHER PUBLICATIONS

"Molybdenum—ML (Molydenum-Lanthanum Oxide)", Plansee, Nov. 1, 2015, https://web.archive.org/web/20151101003616/http://www.plansee.com/en/materials/molybdenum.html (Plansee) (Year: 2015).*

* cited by examiner

*Primary Examiner* — Daniel J. Schleis
*Assistant Examiner* — Kevin Ct Li
(74) *Attorney, Agent, or Firm* — Mintz Levin Cohn Ferris Glovsky and Popeo, P.C.; Peter F. Coriess

(57) ABSTRACT

A coating method for a friction part according to the present disclosure includes the steps of: fabricating a wire comprising, by weight, 0.1% to 1.0% of $La_2O_3$ and a balance of Mo; and applying, by flame spraying, the fabricated wire to a surface of the friction part, whereby the friction part has improved wear resistance.

2 Claims, 4 Drawing Sheets

(51) Int. Cl.

| | |
|---|---|
| ***C22C 38/60*** | (2006.01) |
| ***C22C 38/18*** | (2006.01) |
| ***C22C 38/08*** | (2006.01) |
| ***C22C 38/04*** | (2006.01) |

FRICTION PART HAVING WEAR RESISTANT COATING AND COATING METHOD THEREFOR

CROSS-REFERENCE TO RELATED APPLICATION

The present application claims the benefit of priority to Korean Patent Application No. 10-2017-0171571 filed on Dec. 13, 2017, the entire contents of which are incorporated herein for all purposes by reference.

BACKGROUND OF THE DISCLOSURE

1. Technical Field

The present disclosure relates to a friction part having a wear resistant coating and a coating method therefor and, more specifically, to a friction part provided with a wear resistant coating to enhance wear resistance in a part which is affected by the friction generated in an engine or a powertrain, and a coating method therefor.

2. Description of the Related Art

With recent improvements of engine power and multi-stage gears, parts in engines and powertrains are now capable of undergoing more severe or extreme friction conditions than in the past. Particularly, a large amount of friction occurs at contact points where a piston ring and a crankshaft, which are both applied to an engine, and a shift fork, which is a powertrain part applied to a dual-clutch transmission (DCT), respectively rotate and engage with/disengage from respective counterparts.

Conventionally, pure molybdenum (Mo) has been applied to a surface of a friction part by a flame spraying process to form a wear resistant layer. However, due to its process traits, the flame spray coating often forms an uneven surface. Accordingly, shear wear can still occur even if a Mo coating layer is formed by flame spraying.

Therefore, there is a need for a new coating material and coating method for improving surface roughness as well as wear resistance through flame spraying.

The above information described as the background art is merely for enhancement of understanding of the general background of the disclosure and should not be taken as an admission that this information corresponds to a prior art already known to a person skilled in the art.

SUMMARY OF THE DISCLOSURE

The present disclosure has been made to solve the above-described problems, and a purpose of the present disclosure is to provide a friction part having a wear resistant coating thereon with improved surface roughness and a coating method therefor.

According to embodiments of the present disclosure, a method for producing a friction part is provided that can include the steps of: (a) fabricating a wire for applying to a friction part, the wire including a composite or admixture of one or more metal oxide compounds and molybdenum that are present by weight, (i) about 0.1% to 1.0% of one or more metal oxide compounds and (i) at least a substantial weight balance of the composite or admixture being molybdenum (Mo); and (b) applying the fabricated wire to a surface of the friction part. Particularly, the metal oxide compounds may include at least one or more oxides of lanthanum (La), zirconium (Zr), yttrium (Y) or cerium (Ce). The fabricated wire can be applied by a variety of methods including spray coating such as for example flame spray coating or arc spray coating.

The molybdenum (Mo) will be present in an amount that is at least the substantial weight balance of the metal oxide:molybdenum composite or admixture (which may be the wire). For instance, molybdenum may be present in an amount of at least 85, 90, 91, 92, 93, 94, 95, 96, 97, 98, 99, 99.1, 99.2, 99.3, 99.4, 99.5, 99.6, 99.7, 99.8 or 99.9 weight percent based on total weight of the metal oxide:molybdenum composite (which may be the wire). In certain preferred aspects, the metal oxide:molybdenum composite (which may be the wire) will only include the one or more metal oxide compounds and molybdenum. However, in other aspects, one or more other materials also suitably may be present with the one or more metal oxide compounds and molybdenum.

The term "metal oxide compounds", "metal oxide compound" or "metal oxide" as used herein refers to a compound having at least one or more metal components and oxygen and the metal component and oxygen may be bonded (e.g., covalent bond). The metal components as used herein may be any one selected from alkali metals, alkali-earth metals, transition metals, post-transition metals, lanthanides or actinides. For instance, the metal oxide compounds may include at least one or more oxides of lanthanum (La), zirconium (Zr), yttrium (Y) or cerium (Ce).

Preferably, the fabricated wire may be applied to the surface of the friction part by spray coating, preferably for example by flame spraying or arc spraying.

The wire may suitably include $La_2O_3$, $ZrO_2$, $Y_2O_3$, $Ce_2O_3$, or combinations thereof. Preferably, the the wire may include $La_2O_3$ either as the sole metal oxide material or in combination with one or more additional metal oxide such as $ZrO_2$. The wire may preferably include, by weight, an amount of about 0.1 or 0.3 to 1.0% of one or more metal oxide materials such as $La_2O_3$.

The fabricating step can include fabricating the wire so as to have a suitable diameter such as 1 mm to 5 mm. Particularly preferred diameters of the wire may vary depending on the application method as further discussed herein.

The fabricating step can include melting an ingot including the one or more metal oxide compounds and Mo; and drawing the molten ingot to fabricate the wire.

Furthermore, according to embodiments of the present disclosure, a friction part can include: a main body of a friction part; and a coating layer formed on a surface of the main body and including, by weight, an amount of about 0.1% to 1.0% of one or more metal oxide compounds and a balance of molybdenum (Mo). Particularly, the metal oxide compounds may include at least one or more oxides of lanthanum (La), zirconium (Zr), yttrium (Y) or cerium (Ce).

The term "friction part" as used herein refers to a part where severe or extreme friction conditions are applied, for example, by rotating, engaging with or disengage from counterparts. Examples of the friction part may include, not be limited to, multistage gears, parts in engines and powertrains, such as a crankshaft, a shift fork, a powertrain part applied to a dual-clutch transmission (DCT), or the like.

The coating layer may suitably include $La_2O_3$, $ZrO_2$, $Y_2O_3$, $Ce_2O_3$, or combinations thereof in combination with Mo as disclosed herein.

Preferably, in certain embodiments the coating layer may include $La_2O_3$ and $ZrO_2$ together with Mo. In such embodiments, the coating layer may include, by weight, an amount of about 0.1 or 0.3 to 1.0% of $La_2O_3$ and $ZrO_2$.

In certain other embodiments the coating layer may include $La_2O_3$ together with Mo. In such embodiments, the coating layer may include, by weight, an amount of about 0.1 or 0.3 to 1.0% of $La_2O_3$.

The coating layer suitably can be formed so as to have a surface roughness of 40 μm or less, including for example 35 μm, 30 μm, or 25 μm, or less.

The coating layer e suitably may comprise pores that have diameters not exceeding 50 μm or 45 μm, or 40 μm.

The main body of the friction part may include, by weight, an amount of about 3.0% to 4.0% of carbon (C), an amount of about 2.0% to 3.0% of silicon (Si), an amount of about 0.2% to 0.6% of manganese (Mn), an amount of about 0.1% or less of phosphorus (P), an amount of about 0.15% or less of sulfur (S), an amount of about 1.0% or less of nickel (Ni), an amount of about 0.3% or less of chromium (Cr), and a balance of Fe and inevitable impurities.

While the present coatings are disclosed as being applied as a wire of the metal oxide(s):Mo composite, other procedures also can be employed such as application e.g. spray coating of a powder of the metal oxide(s):Mo composite.

In preferred aspects, metal oxide(s):Mo composite as disclosed herein as applied such as by spray coating on a substrate surface may comprise droplets that have a disc shape (i.e. not spherical or not splash form). We have found that a disc form (including relatively flat, thin disc form and not spherical shaped) coating layer of the present metal oxide(s):Mo composite can be provided, including by a spray coating application such as a flame spray other spray application of a wire of the present metal oxide(s):Mo composite as disclosed herein.

A metal oxide(s):Mo composite coating layer comprising such droplets of disc form can provide a higher quality (particularly, enhanced surface toughness) coating layer of the metal oxide(s):Mo composite.

Further provided is a vehicle or vehicle part that may include the friction part as described herein.

According to the wear resistance coated friction part and a coating method therefor described herein, at least the following effects can be obtained.

First, enhanced surface roughness is achieved, with the resultant minimization of friction wear.

Second, the coating layer exhibits improved adhesion to the base material mother, and thus is prevented from being defoliated therefrom.

Finally, the coating layer has a reduced number of pores therein, and thus exhibits enhanced wear resistance.

BRIEF DESCRIPTION OF THE DRAWINGS

The above and other aspects, features and advantages of the present disclosure will be more apparent from the following detailed description taken in conjunction with the accompanying drawings, in which.

Figure 1:
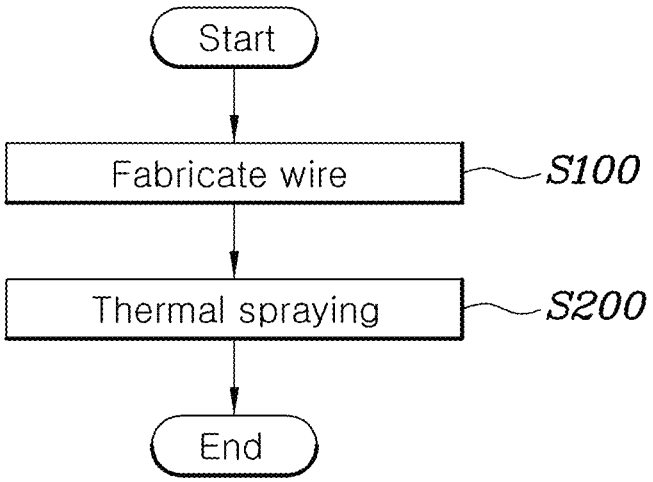
FIG. 1 is a flowchart of a coating method for a friction part according to embodiments of the present disclosure.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms are intended to include the plural forms as well, unless the context clearly indicates otherwise. It will be further understood that the terms "comprises" and/or "comprising," when used in this specification, specify the presence of stated features, regions, integers, steps, operations, elements, and/or components, but do not preclude the presence or addition of one or more other features, regions, integers, steps, operations, elements, components, and/or groups thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a friction part having a wear resistant coating and a coating method therefor according to exemplary embodiments of the present disclosure will be described with reference to the accompanying drawings.

FIG. 1 is a flowchart of a coating method for a friction part according to embodiments of the present disclosure. As shown in FIG. 1, the present disclosure comprises a step of fabricating a wire (S100) and a step of flame spraying (S200).

In the step of fabricating a wire (S100), a wire including, by weight, an amount of about 0.1% to 1.0% of one or more metal oxide compounds, and a balance of Mo may be fabricated. In some embodiments, the wire may include $La_2O_3$, $ZrO_2$, $Y_2O_3$, $Ce_2O_3$, or combinations thereof. Preferably, the wire may include $La_2O_3$ and $ZrO_2$ as a metal oxide component, or solely $La_2O_3$ as the metal oxide component. For example, the wire comprises, by weight, an amount of about 0.3 to 1.0% of $La_2O_3$ and $ZrO_2$ or 0.3 to 1.0% of $La_2O_3$.

In this regard, an ingot comprising the above composition may be preferably melted and then formed into a wire rod by a drawing process. Hereinafter, unless defined otherwise, % means wt %.

Mo is an essential component accounting for the wear resistance of the coating layer formed such as by flame spraying. Conventionally, flame spraying is performed with pure Mo (purity of 99.99% or more). In the present disclosure, however, the material is applied such as by the flame spraying with a spray wire that further includes one or more metal oxides such as lanthanum oxide ($La_2O_3$).

In certain applications, $La_2O_3$ (alone or together or in conjunction with other metal oxide materials) is a component added to form a thin and wide coating layer on a surface of a base material as it allows droplets to have a disc form during spray coating such as flame spraying. When $La_2O_3$ or other metal oxide as disclosed herein is added in an amount of less than 0.1 weight %, droplets may not or will not have a disc form during spray coating such as flame spraying. On the other hand, when $La_2O_3$ is added in an amount exceeding 1.0 weight %, the resultant reduced content of Mo rather has an adverse effect on wear resistance. For instance, use of one or more metal oxides such as $La_2O_3$ in an amount in excess of 1.0 weight % can make fabrication of an metal oxide:Mo composite wire more difficult due to increased brittleness of the wire material. Therefore, the content of $La_2O_3$ and/or other metal oxides is limited to an amount of about 0.1% to 1.0% by weight based on the total weight to the wire.

In applying a wire of the metal oxide-Mo composite, the wire suitably may have a variety of dimensions, such as for instance 5 mm or less, including 1-5 mm, or 1-4 mm. A wire diameter of 3-4 mm will be suitable for at least certain application methods such as flame spray. For an arc spray application, a wire diameter of from 1 or 1.5 mm to 2, 3, or 4 mm may be particularly suitable.

For at least certain application methods, when a diameter of a wire is less than about 1 mm, the wire cannot smoothly supply molten droplets to cause the formation of an uneven coating layer during flame spraying. When the diameter exceeds 4 or 5 mm, it is difficult to apply the wire to spraying equipment.

When wire fabrication is performed by doping a wire made of Mo $La_2O_3$ rather than by melting and drawing processes, $La_2O_3$ is injected only on a surface of the wire and thus the droplets are not in even disc forms. Therefore, a wire is preferably fabricated by melting an ingot including the above-mentioned composition of Mo and $La_2O_3$ and then drawing the molten ingot.

In the flame spraying (S200), a wear resistant coating layer may be formed on a surface of a friction part by performing the flame spraying process under the conditions including, for example, a spray gun speed of 18 mm to 20 mm/s, a compressed air flow rate of 22 SCFM to 24 SCFM (standard cubic feet per minute), and an acetylene flow rate of 30 SCFM to 35 SCFH (standard cubic feet per hour).

The spray gun speed determines a coating area per unit time and the compressed air flow rate and the acetylene flow rate account for intensity and discharge pressure of flame. When flame spraying is performed under the above described condition, a coating layer having a roughness (Rz) of 40 μm or less may be formed.

Examples of a friction part, which is an object to be subjected to the above-described coating process, include a shift fork, a piston ring, a crank shaft, or the like.

Figure 2:
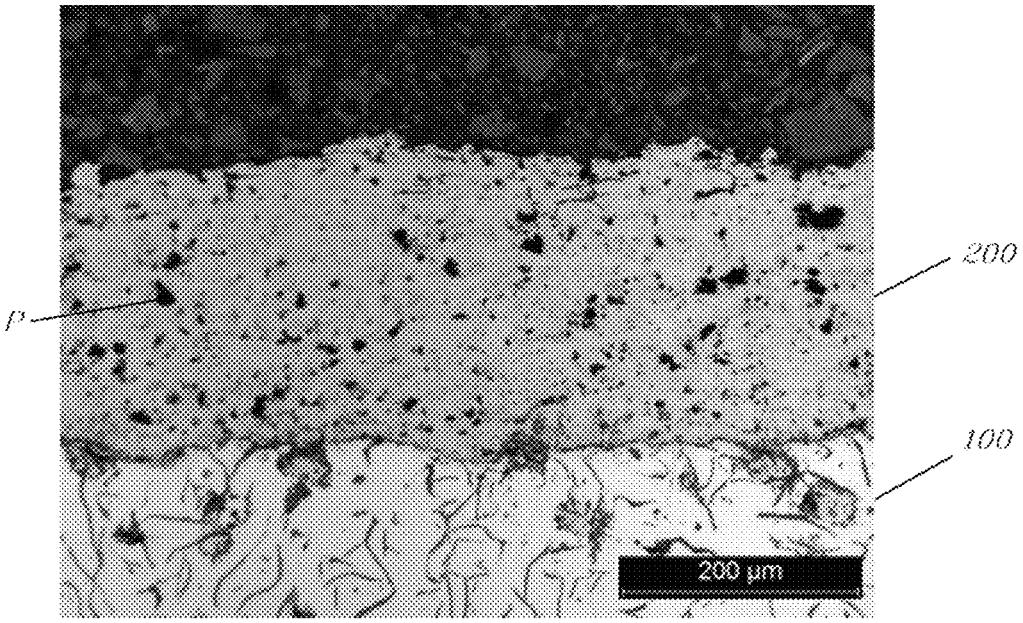
FIG. 2 is a microscopic image showing a cross-sectional morphology of a friction part having a coating layer formed by a coating method for a friction part according to embodiments of the present disclosure.
Figure 3:
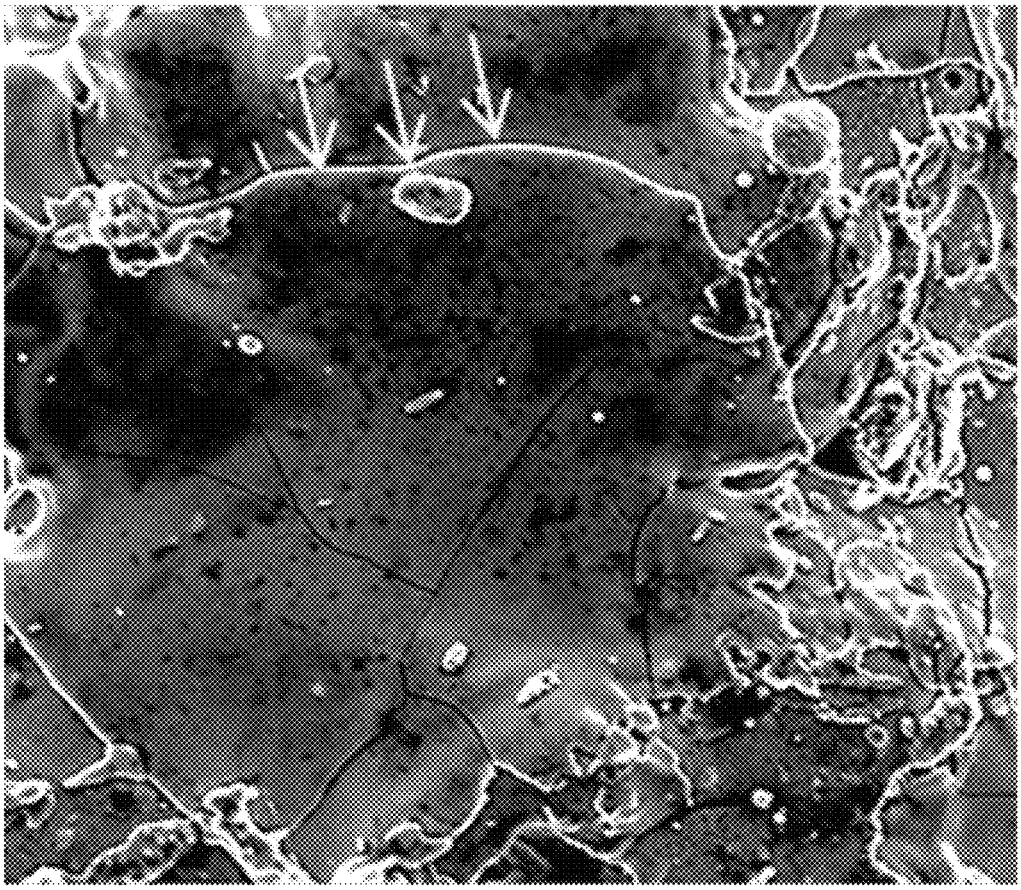
FIG. 3 is a microscopic image showing a surface morphology of a friction part having a coating layer formed by a coating method for a friction part according to embodiments of the present disclosure.

FIG. 2 is a microscopic image showing a cross-sectional morphology of a friction part having a coating layer formed by a coating method for a friction part according to embodiments of the present disclosure, and FIG. 3 is a microscopic image showing a surface morphology of a friction part having a coating layer formed by a coating method for a friction part according to embodiments of the present disclosure.

As shown FIGS. 2 and 3, the friction part fabricated by the above-described coating method includes a main body 100 and a coating layer 200 formed thereon.

The main body 100 of the friction part may be, for example, a shift fork, and may be made of a material including, by weight, an amount of about 3.0% to 4.0% of carbon (C), an amount of about 2.0% to 3.0% of silicon (Si), an amount of about 0.2% to 0.6% of manganese (Mn), an amount of about 0.1% or less of phosphorus (P), an amount of about 0.15% or less of sulfur (S), an amount of about 1.0% or less of nickel (Ni), an amount of about 0.3% or less of chromium (Cr), and a balance of Fe and inevitable impurities. As described in the coating method above, the coating layer 200 may include, by weight, an amount of about 0.1% to 1.0% of one or more metal oxide compounds and a balance of molybdenum (Mo). In particular, the metal oxide compounds may include at least one or more selected from lanthanum (La), zirconium (Zr), yttrium (Y) or cerium (Ce). The coating layer may suitably include $La_2O_3$, $ZrO_2$, $Y_2O_3$, $Ce_2O_3$, or combinations thereof. Preferably, the coating layer may include $La_2O_3$ and $ZrO_2$. For instance, the coating layer may include an amount of about 0.1% to 1.0% of $La_2O_3$, and a balance of Mo.

The coating layer 200 thus obtained has a hardness of 1000 Hv to 1100 Hv, a roughness (Rz) of 30 μm to 40 μm, and an adhesion of 6 MPa to 7 MPa.

Particularly, since a droplet widely spreads to have a disc form during flame spraying, the coating layer 200 exhibits excellent surface roughness and high adhesion with pores (P) becoming smaller in size and the number therein. In this regard, the pores (P) formed in the coating layer 200 have a diameter of 50 μm or less.

Figure 4:
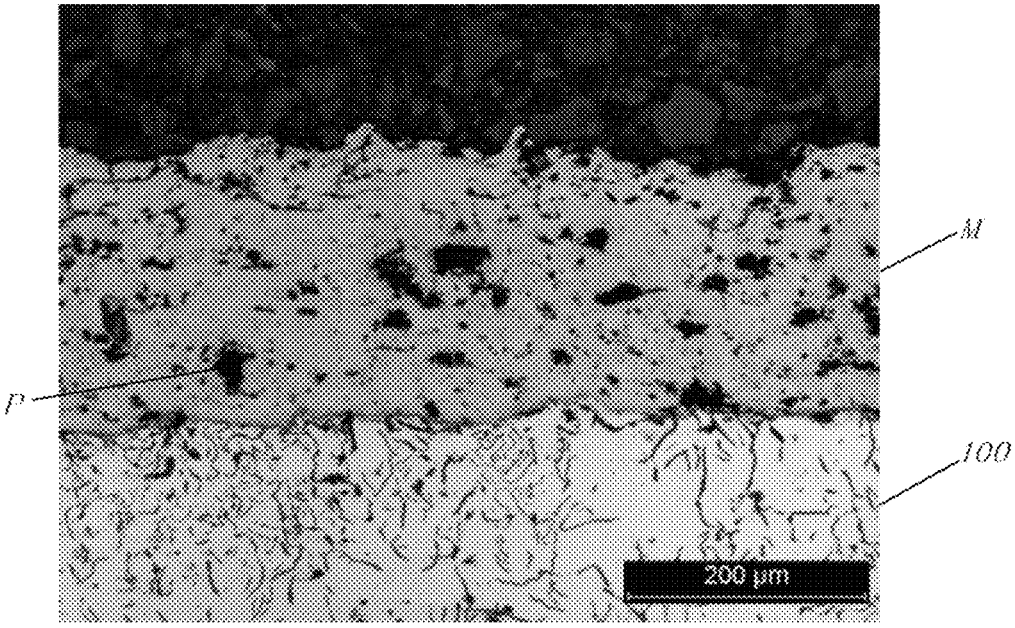
FIG. 4 is a microscopic image showing a cross-sectional morphology of a friction part coated with Mo by conventional flame spraying.
Figure 5:
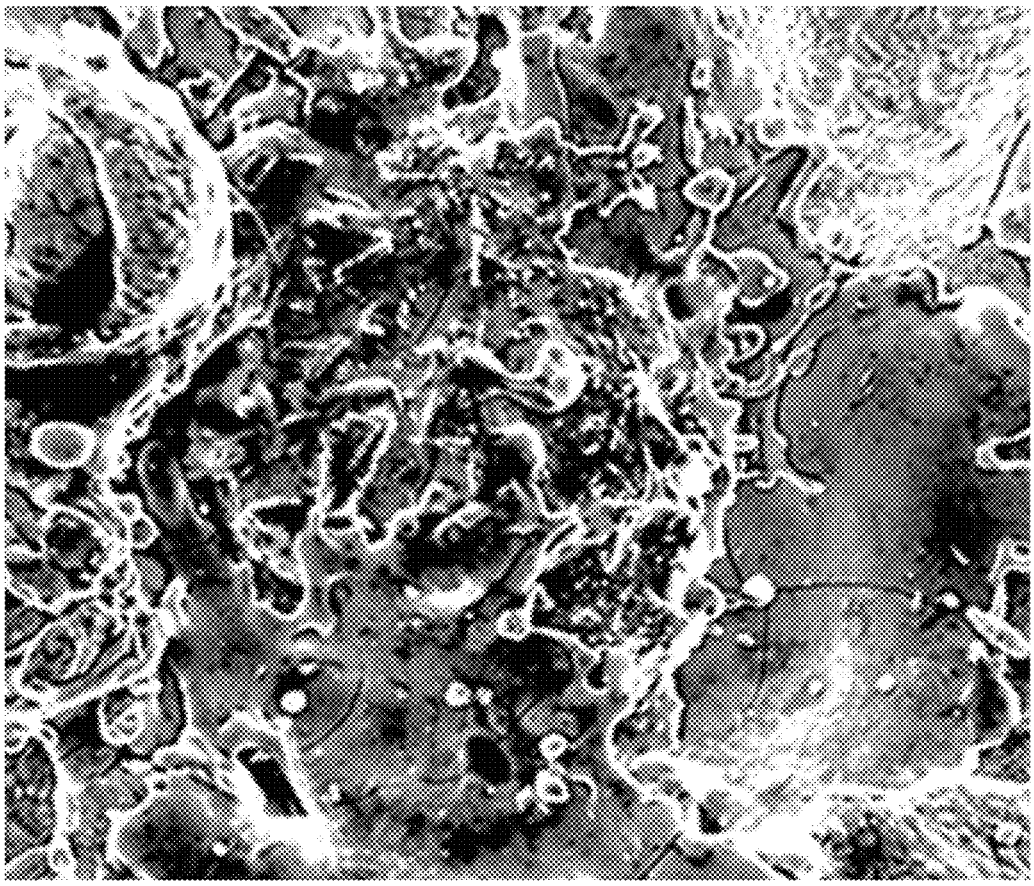
FIG. 5 is a microscopic image showing a surface morphology of a friction part coated with Mo by conventional flame spraying.

Meanwhile, FIG. 4 is a microscopic image showing a cross-sectional morphology of a friction part coated with conventional Mo by flame spraying, and FIG. 5 is a microscopic image showing a surface morphology of a friction part coated with Mo by conventional flame spraying.

As shown in FIGS. 4 and 5, since a coating layer (M) made of pure Mo by flame spraying are attached as droplets during flame spraying, the coating layer (M) has a poor roughness with pores (P) increasing in size and number therein. In particular, pores having a diameter exceeding 50 μm are formed, lowering wear resistance.

Physical properties of friction parts which are provided with coating layers according to Examples of the present disclosure and with coating layers consisting of pure Mo according to Comparative Example are given in Table 1, below.

TABLE 1

| | Example 1 | Example 2 | Comparative Example |
|---|---|---|---|
| Spray coating material | 0.25% $La_2O_3$—Mo | 0.35% $La_2O_3$—Mo | Mo 100% |
| Coating layer thickness(μm) | 100~150 | 100~150 | 100~150 |
| Hardness(Hv) | 1080 | 1012 | 1018 |
| Roughness(Rz) | 32.4 μm | 32.6 μm | 41.9 μm |
| Adhesion | 6.0 | 6.3 | 6.1 |
| Maximum wear depth(μm) | 18.3 | 15.6 | 44.5 |

As shown in Table 1, both the Examples 1 and 2 in which 0.1% to 1.0% of $La_2O_3$ were added exhibited excellent roughness at a level of 32 μm to 33 μm, whereas the Comparative Example exhibited poor roughness exceeding 40 μm. In addition, the Examples showed equivalent levels of hardness and adhesion to those in the Comparative Example.

The maximum wear depth was evaluated by a wear resistance test based on the block on ring test according to ASTM G77. In the block on ring test, a hexahedral block is measured for wear depth by forming a coating layer on a surface of the block, contacting the block with an outer circumferential surface of a disc-type ring and then rotating the ring at a predetermined rotation speed.

As for test conditions, the ring is rotated at the following speeds, with a load of 500 N applied between the block and the ring. The test was conducted for a total of 5 minutes, that is, at 500 rpm for 1 minute, at 1000 rpm for 1 minute, at 1500 rpm for 1 minute, and at 2000 rpm for 1 minute.

The ring, serving as a counter material, was manufactured by carburizing a SCr420HB steel material.

The test result shows that the coating layer formed by the method according to the present disclosure had a wear depth of 15 to 20 μm which is an excellent level, whereas the coating layer of the comparative example is greatly worn down to more than 40 μm.

Particularly, in the Comparative Example, there occurred a phenomenon by which a significant amount of the counter material was adhered and transferred to the coating layer because the Comparative Example has a poor roughness and wore the counter material.

While the present disclosure has been described in detail with reference to certain exemplary embodiments thereof, it will be well understood by those of ordinary skill in the art that the present disclosure may be embodied in various different forms all without departing from the spirit or essential characteristics thereof.

It is therefore to be understood that the above-described embodiments are illustrative in all aspects and not restrictive. The scope of the present disclosure is defined by the appended claims rather than the detailed description, and all changes or modifications derived from the meaning and scope of the claims and their equivalents should be interpreted as being included in the scope of the present disclosure.

What is claimed is:

1. A coated friction shift fork of a vehicle consisting of a main body comprising a base material consisting of, by weight, an amount of 3.0% to 4.0% of carbon (C), an amount of 2.0% to 3.0% of silicon (Si), an amount of 0.2% to 0.6% of manganese (Mn), an amount of 0.1% or less of phosphorus (P), an amount of 0.15% or less of sulfur(S), an amount of 1.0% or less of nickel (Ni), an amount of 0.3% or less of chromium (Cr), and a balance of Fe and inevitable impurities; and a coating layer formed on a surface of the main body, the coating layer consisting of, by weight, 0.3% to 1.0% of $La_2O_3$ and a balance of molybdenum (Mo), wherein, the coating layer is formed so as to have a surface roughness of 40 μm or less, wherein the coating layer comprises pores having a diameter not exceeding 50 μm, and wherein the coating layer on a surface of friction part comprises droplets having a disc form.

2. A vehicle comprising the coated shift fork part of claim 1.

* * * * *